US005415310A

United States Patent [19]

Simms

[11] Patent Number: 5,415,310

[45] Date of Patent: May 16, 1995

[54] COLLAPSIBLE NON-STRAPPED PASTE BIN

[75] Inventor: Stanton E. Simms, Ceres, Calif.

[73] Assignee: Calpine Containers, Inc., Modesto, Calif.

[21] Appl. No.: 962,770

[22] Filed: Oct. 19, 1992

[51] Int. Cl.[6] ..... B65D 9/00

[52] U.S. Cl. ..... 220/4.28; 217/12 R; 217/69

[58] Field of Search ..... 220/4.28, 4.33, 7, 1.5, 220/692, 693; 217/69, 12 R, ; 229/190.1

[56] References Cited

U.S. PATENT DOCUMENTS

| | | | |
|---|---|---|---|
| 419,109 | 1/1890 | Campany | 217/12 R |
| 1,003,016 | 9/1911 | Wallis et al. | 217/69 |
| 1,155,206 | 9/1915 | Brock et al. | 217/12 R |
| 1,184,505 | 5/1916 | Bacon | 217/69 |
| 1,484,829 | 2/1924 | Huguenin | 217/69 |
| 1,691,158 | 11/1928 | Lion | 217/69 |
| 1,953,763 | 4/1934 | Maurer, Jr. | 217/69 |
| 2,017,161 | 10/1935 | Pennock et al. | 217/12 R |
| 2,366,532 | 1/1945 | Jones et al. | 217/69 |
| 2,460,104 | 1/1949 | Rapp | 217/12 R |
| 3,235,118 | 2/1966 | Kewley | 217/69 X |
| 3,342,364 | 9/1967 | Bingham et al. | 217/69 |
| 3,433,381 | 3/1969 | Nagler | 217/69 |
| 3,477,604 | 11/1969 | Kridle | 217/12 R |
| 3,485,433 | 12/1969 | Rapp | 217/69 X |

*Primary Examiner*—Steven M. Pollard
*Attorney, Agent, or Firm*—Townsend and Townsend Khourie and Crew

[57] ABSTRACT

A paste bin is disclosed in which the combination of self locking corner irons enable both the elimination of straps utilized to hold the containers together as well as the relatively complex pre-strapping assembly. Accordingly, self locking corner irons are placed on the off pallet sides of the container with two such self locking corner irons being on either vertical side of the off pallet side of the bin. Each of these corner irons consists of eleven gauge (⅛ inch) steel strips bent at 90° to form two longitudinally extending side capturing edges. The vertical dimension of the self locking corner irons is slightly less than all of the height of the sides. On the off pallet side, the edge of the corner irons includes punched intermittent annular inwardly protruding male flanges. These inwardly protruding annular male flange are for receiving the heads of flat head machine screws for permanently fastening the self locking corner irons to the off pallet sides. The opposite bent edge of the self locking corner irons are fitted with returns, these returns constituting preferably 90° inward bends at the side edge of the strip edge. The purpose of these returns is to key to saw kerfs formed within adjoining bin sides. A corner locking mechanism temporarily holds the bin in the erected state until paste contents are placed within the erected bin. The entire construction when assembled and loaded with respect to the pallet having an upwardly exposed integral bottom constitutes a self locking construction for the transport and storage of paste.

14 Claims, 3 Drawing Sheets

COLLAPSIBLE NON-STRAPPED PASTE BIN

This invention relates to so-called paste bins. A 300 gallon paste bin having a conventional plywood construction is disclosed which does not require horizontal strapping and can be easily assembled at the time that the paste contents are placed interior of the bin for shipping and storage.

BACKGROUND OF THE INVENTION

So-called paste bins, commonly used for tomato and other fruit and vegetable pastes, are known. The bins are constructed of 1⅛" plywood on top of a conventional pallet. Typically, these paste bins are constructed on a pallet with the plywood pallet top serving as the paste bin bottom. The bin bottom is not only integral with the pallet but is recessed with respect to the pallet so that the bin bottom fits interior of the side walls of the pallet. Typically, the bottom of the bin as integrally constructed to the pallet defines at the side edges spatial intervals for receiving the sides of the bin.

In conventional assembly, the bins are usually assembled by the carton supplier. Typically, the containers are recycled and shipped in a disassembled configuration with the sides and tops stacked flat on top of the pallet from the food processor using the paste to the bin manufacturer; alternately, the newly constructed box bins are assembled for the first time at the bin manufacturer.

In assembly, the sides of the container are erected with respect to the pallet and temporarily held in the erect position. Thereafter, usually four horizontal straps are placed about the sides under tension so that the erected sides are rigidly held in place. Finally, the top is placed on the bin and the bin is shipped to the producer of the paste.

Once the erected bin arrives at the at the producer of the paste—and is ready to be filled with paste, the top is removed from the assembled bin. Typically, a two ply polyvinyl liner is placed interiorly of the bin. Thereafter, the paste contents are placed in the interior, and the top is placed on and strapped about the container. Thereafter, the filled container is shipped and stored.

The tomato paste is emptied from the bin at a food processing plant. Thereafter, the bin is disassembled. Typically, and when the paste is removed, the horizontal binding straps are cut, stripped and discarded. Thereafter, the bin sides and top are broken down and placed on top of the pallet. When this is done, the bin is returned to the bin manufacturer for reassembly.

It will be understood that the bins of the prior art require shipping between at least three commercial locations. These locations are the place of bin manufacture, the plant where the bins are loaded with paste, and the plant of the food processor where the paste is used.

It will be understood that the logistics, including transport and supply of the containers are other than trivial. For example, and assuming that the bins are separately hauled in truck load lots, approximately 148 bins are shipped in a disassembled disposition and 58 can be shipped in an assembled disposition. When one realizes that hundreds of thousands of such bins are in use in California's Central Valley alone, the magnitude of the required shipping traffic can be more clearly understood.

It thus will be understood that the shipping of the bin for re-assembly to the box manufacturer has disadvantages. The users of the bin must contract with the box manufacturer for the pre-strapping reassembly of the boxes prior to the bins being filled with paste. In such contracting, the user is placed in a vulnerable position of having to react to the contractors problems with supplier (as where the required straps are not delivered on time), machinery suppliers (subject to breakdowns and unavailable spare parts), and the required employees re-assembling the bins. Even where the user has in-house facilities for the re-strapping assembly of the bins, complications of re-assembly are other than convenient.

TERMINOLOGY

For the convenience of this specification, and in referring to the particular sides of the bin disclosed, reference will be made to the terms "on pallet" and "off pallet." As those familiar with pallets readily know, such pallets are typically moved by fork lifts. These lifts can only penetrate spatial intervals on two opposite sides of a square pallet. Consequently, these opposite sides of a pallet will here after be referred to as the "on pallet" sides. Similarly, those sides of the pallet—again two opposite sides—which cannot be penetrated by a pallet—will be referred to as "off pallet" sides.

SUMMARY OF THE INVENTION

A paste bin is disclosed in which the combination of self locking corner irons enable both the elimination of straps utilized to hold the containers together as well as the relatively complex pre-strapping assembly. Accordingly, self locking corner irons are placed on the off pallet sides of the container with two such self locking corner irons being on either vertical side of the off pallet side of the bin. Each of these corner irons consists of eleven gauge (⅛ inch) steel strips bent at 90° to form two longitudinally extending side capturing edges. The vertical dimension of the self locking corner irons is slightly less than all of the height of the sides. On the off pallet side, the edge of the corner irons includes punched intermittent annular inwardly protruding male flanges. These inwardly protruding annular male flanges are for receiving the heads of flat head machine screws for permanently fastening the self locking corner irons to the off pallet sides. The opposite bent edge of the self locking corner irons are fitted with returns, these returns constituting preferably 90° inward bends at the side edge of the strip edge. The purpose of these returns is to key to saw kerfs formed within adjoining bin sides.

Assembly of the self locking corner irons can be easily understood. The off pallet sides of the container are trimmed in overall width to fit interiorly of the corner irons. These off pallet sides are bored from the exterior toward the interior with counter sunk apertures and central bores for receiving the inward annular flanges on the inside edge of the self locking corner irons. Thereafter, a three prong T-nut is fixed from the inside of the central bore to and toward the inwardly protruding annular flange punched to the inside of the self locking corner iron. This T-nut defines female interior threads for receiving the male exterior threads of a flat head machine screw. Threading of a machine screw from the edge of the corner irons to the T-nut effectively fastens the corner irons to the off pallet sides. Accordingly, and on opposite vertical edges of the off pallet sides of the bin, two vertical self locking corner irons are installed with a total of four locking irons being utilized on each discrete bin.

It is necessary to brace the off pallet bin sides relative to the on pallet bins sides when the bin is temporarily erected and before the bin receives its paste contents. Accordingly, each bin is supplied with detachably removable corner clamps. These detachably removable corner clamps are designed to fit between the on pallet sides and the off pallet sides at the upwardly exposed corner. When installed at corners on opposite off pallet sides, the corner clamps temporarily hold the on pallet sides of the bins from falling inward thus maintain the bins in an erect disposition prior to being filled with paste product.

On the on pallet sides of the bin, saw kerfs are placed. Assuming and eleven ply 1⅛ inch thick plywood panel construction, the kerfs extend through approximately three of the eleven plies along the outside vertical edges of the bin sides. These kerfs are spaced inwardly of the sides a sufficient dimension to enable penetration of the protruding returns from off pallet sides into the saw kerfs.

The bins are typically shipped to the bin user in a disassembled disposition with the sides and top stacked upon the pallet at the bottom panel (integrally constructed with respect to the pallet). Typically, one off pallet side is placed on the bin bottom (integral with the pallet) with the self locking corner irons at the returns upwardly facing. Thereafter, the two on pallet sides with the kerf are stacked so as to be placed between the upwardly exposed returns. The remaining off pallet side is offset at the protruding returns of the bottom off pallet bin side, and placed so as to capture on one degree of side to side movement the on pallet sides with the saw kerfs therebetween. Finally, the bin top is added to stack with centering cleats of the top downward exposed between the off pallet sides. When the stack of the sides and top is complete, the pallet is bound by a light plastic strap, either as a single unit or preferably as a stack of such pallets and sides in the order of ten collapsed bin units high. Shipment to the bin user then occurs.

When the pallet is to be utilized, the two off pallet sides are erected to a vertical position adjacent the pallet bottom on the off pallet side. Thereafter, an on pallet side with the kerfs outwardly exposed is placed at its base adjacent the bin bottom and rotated upwardly between the panels. Rotation occurs until the kerf registers to the returns protruding from the off pallet sides. When this registration to the returns occurs, at least one corner lock is clamped over the on pallet side and the off pallet side to maintain the on pallet side vertical with its kerf in registry to the kerf of the off pallet side. Thereafter, the remaining on pallet side is similarly placed, rotated and locked with a detachably removable corner clamp, leaving an erect bin. This erect bin receives a liner, is filled with paste, and appropriately shipped and stored.

When the paste is removed and used from the bin, bin disassembly occurs. This is the reverse of the assembly process. The sides are then stacked and strapped on the pallet with shipment occurring back to the paste processor.

BRIEF DESCRIPTION OF THE DRAWINGS

Other objects, features and advantages of this invention will become more apparent after referring to the following specification and attached drawings in which.

DESCRIPTION OF THE PREFERRED EMBODIMENT

Figure 1:
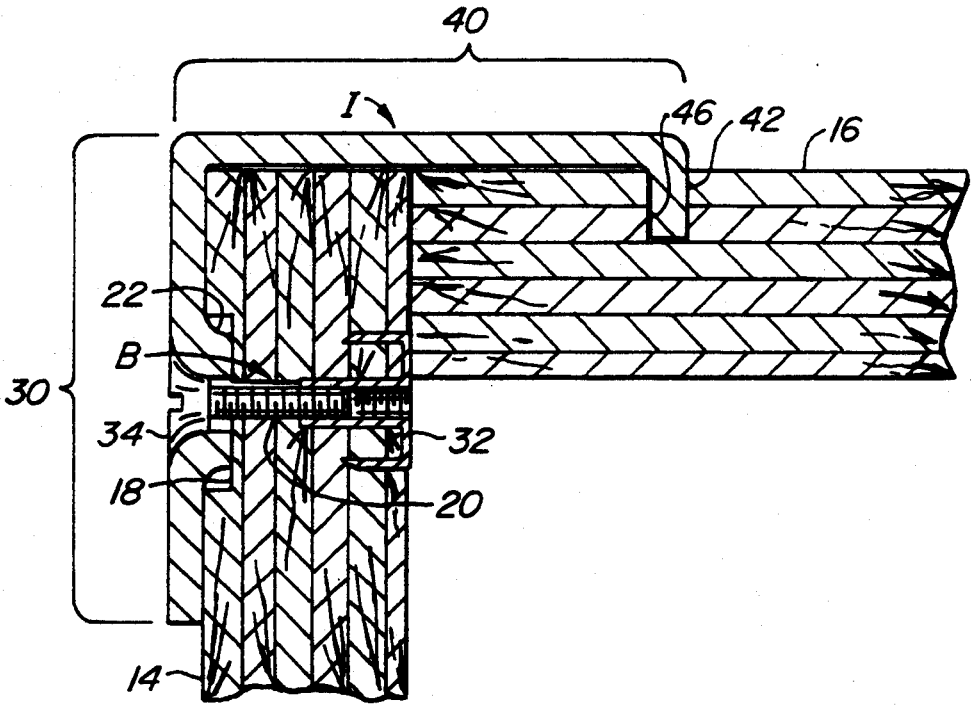
FIG. 1 is a cross section of a complete assembled off pallet side across the corner iron.

Referring to FIG. 1, a detail at the self locking corner iron C is illustrated. The section taken is shown at bolt B.

Off pallet side 14 includes routed counter sunk holes 18 with through bores 20, these holes being spaced at intervals to mate with preformed annular inset flanges 22 formed on off pallet sides 30 of corner iron I. A three prong T-nut 32 is threaded into hole 20 and flat head machine screw 34 used to engage from the side of annular flange 22.

On pallet side 40 of self locking corner iron I includes an inset return 42. Return 42 fits into groove 46 configured into on pallet side 16 of the bin. Typically, groove 46 penetrates a discrete number of plys; in the case of 9 ply, 1¼" plywood, three plys are penetrated by the groove.

The reader will understand that the disclosed cross sectional detail is repeated at the respective corners for secure fastening of the respective sides. For example, I prefer having one such bolt every twelve inches for a total of four bolts per corner iron C.

Figure 2:
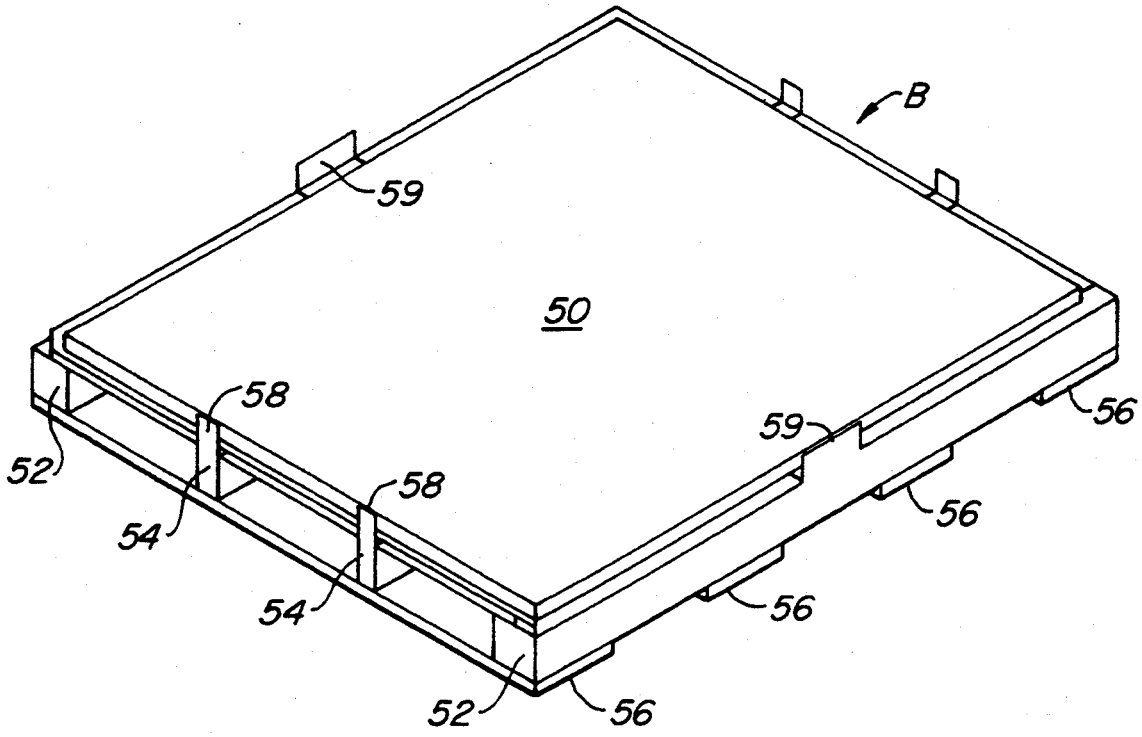
FIG. 2 is a perspective view of a pallet having the bottom formed integrally thereto with respective grooves adjacent the side edge of the bottom for receiving and holding both on pallet and off pallet sides, this pallet being prior art.

Referring to FIG. 2, a perspective view of bin bottom B is illustrated. Bin bottom includes corner stringers 52 with mid pallet stringers 54. These stringers 52, 54 are held in spaced apart relationship by pallet bottom spacers 56 running at right angles to stringers 52, 54. On pallet sides, metal side braces 58 are placed; on off-pallet sides braces 59 are used. An inset bottom 50 forms both the top surface of the pallet and the bin bottom. The inside edges of bottom 50 define an interval equal to the sides between the side edges of bottom 50 and braces 58, 59. It is into these intervals that the bottom side edges of on pallet sides 16 and off pallet sides 14 fit when the bin is assembled.

Figure 3:
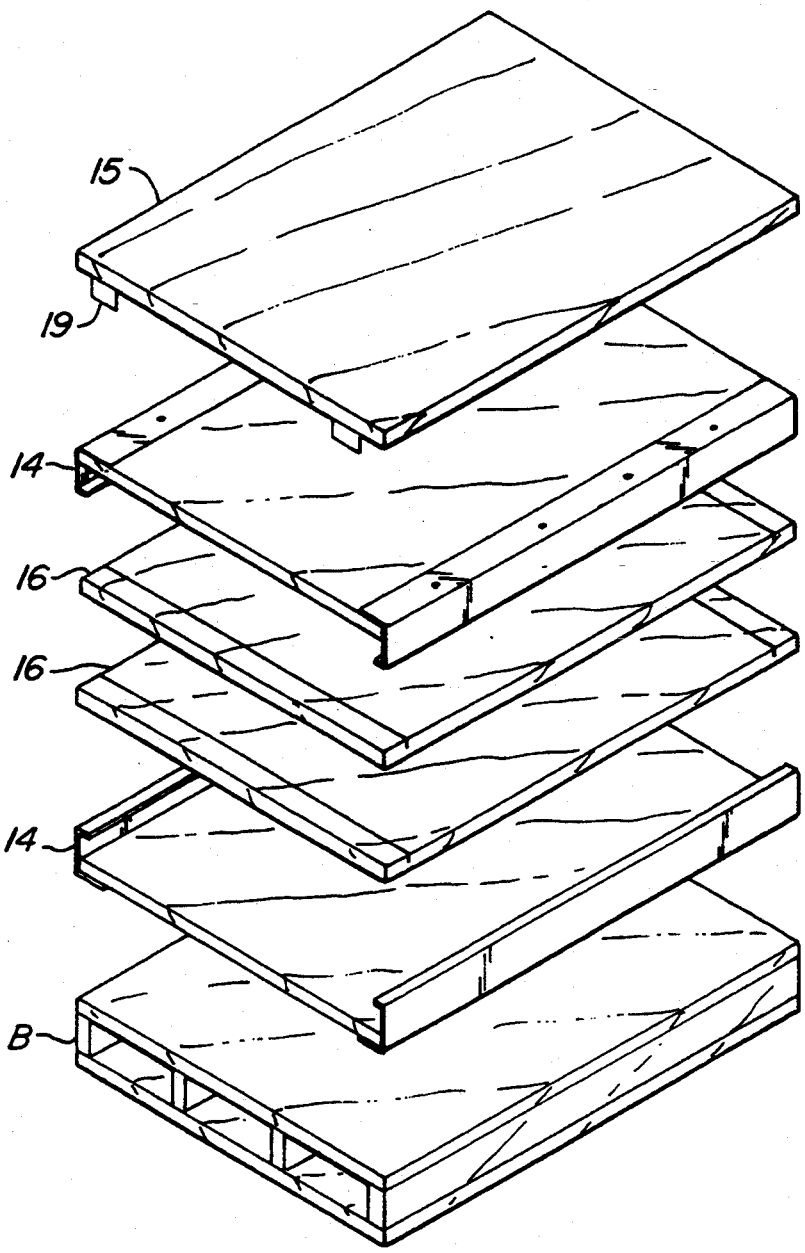
FIG. 3 is an exploded view with one off pallet side having its paired upwardly exposed self locking corner irons stacked directly on the pallet of FIG. 3 with two on pallet sides shown elevated above the pallet, the remaining off pallet side with the downward exposed self locking corner irons for trapping the on pallet sides there between, with the top show having the cleat side down for bracketing over the upward off pallet side and presenting a smooth and uninterrupted upper surface for conventional strapping by light plastic strapping material.

Referring to FIG. 3, an exploded view of the disassembled bin is illustrated with the respective sides being shown in exploded relation one to another so that the disassembled shipment of the boxes can be understood. Bin bottom B includes two respective on pallet sides 16 with their respective corner irons I faced towards one another trapping two off pallet sides 14 there between. A top 15 with inside cleats 19 is shown, which top 15 fit at cleats 19 into the interior of the assembled bin.

Figure 4:
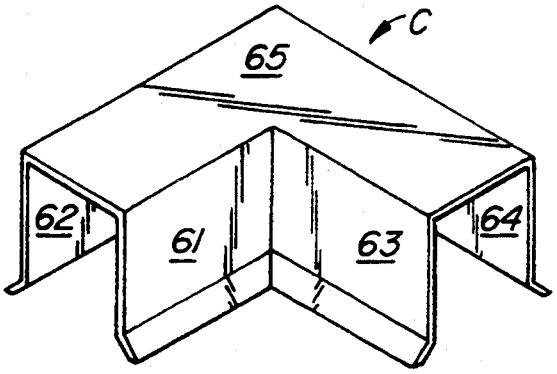
FIG. 4 is a detailed view of a corner clamp.

Referring to FIG. 4, a corner clamp C is illustrated. This corner clamp C includes inside corner braces 61, 62, outside corner braces 62, 64 joined at respective clamp top 65. As will be apparent, only two of these are required per bin—as these respective corner clamps function to hold the erected on pallet 16 erect with the off pallet sides 14 when the bin is assembled.

Figure 5:
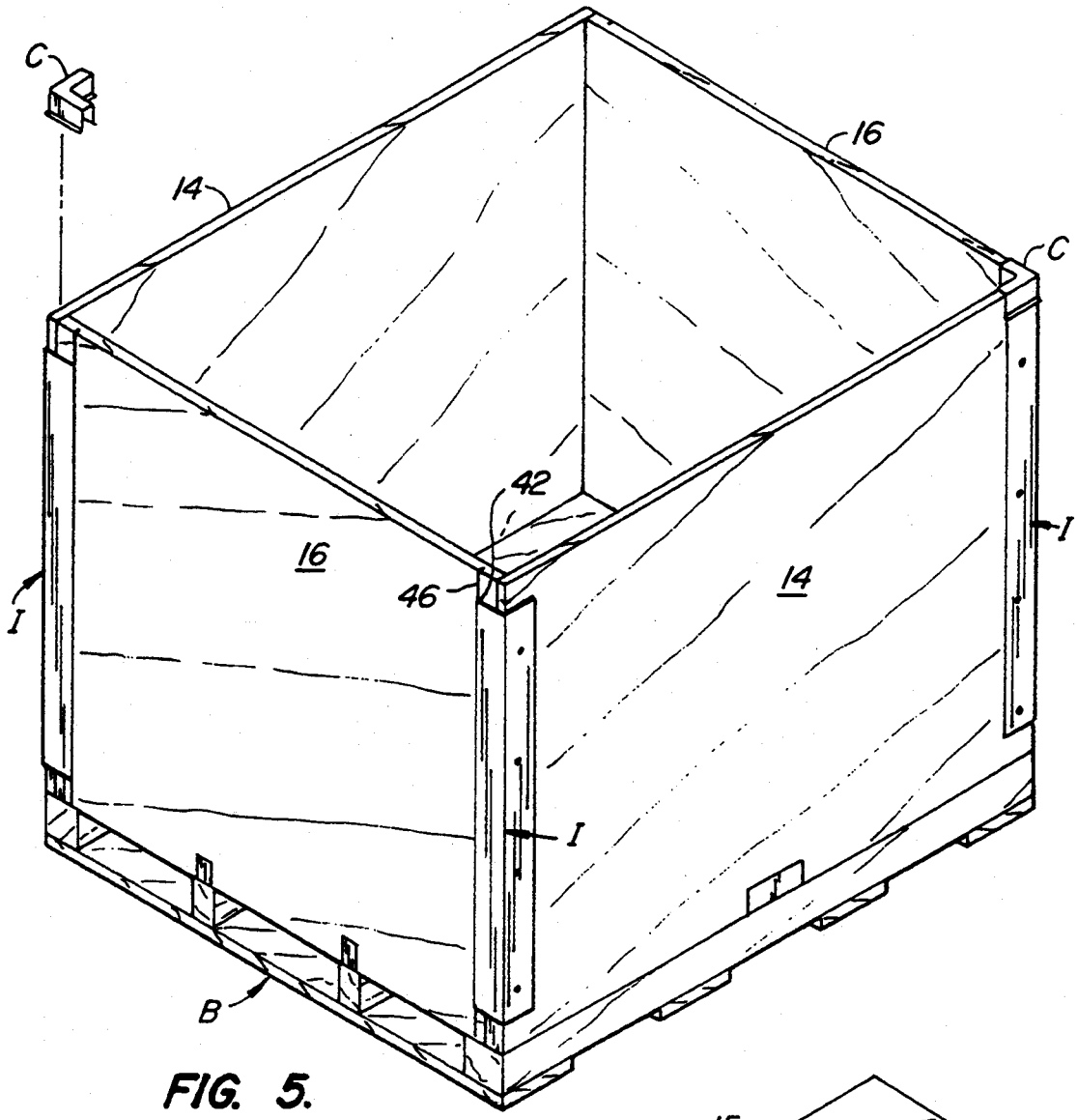
FIG. 5 is a perspective view of two erected off pallet sides having all four corner irons attached illustrating one on pallet side already installed and held vertical by a corner clamp with the remaining on pallet side having been placed and being rotated into it self locking disposition for final locking of the bin in the erected position by corner clamp shown in the overlying exploded relation; and, FIG. 6 is a perspective view of reduced size with the top shown about to be placed over the lined and loaded paste container schematically showing the vertically extending strapping utilized to hold top on during transport and storage.

Referring to FIG. 5, the bin is shown being assembled two on pallet sides 14 have been erected with one on pallet side 16 having been erected and held by corner clamp C with remaining and near on pallet side 16 being rotated into place. As can be seen, return 42 is fitting into routed channel 46 on the exterior of on pallet sides 16. The remaining corner iron C is shown overlying the bin ready to lock the respective near side 16 to the two erected sides 14 once full locking rotation occurs.

Figure 6:
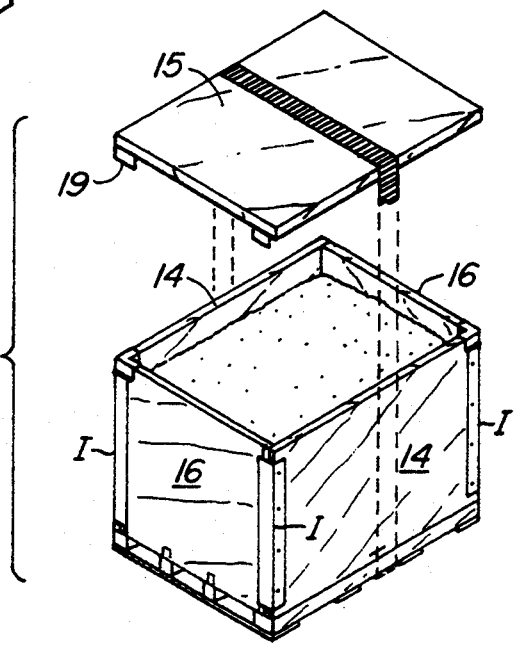

Finally, and with respect to FIG. 6, the assembled bin is illustrated with an interior bin liner 70 with top 15 at cleats 19 fitting into the interior of the assembled bin. As can be seen, only vertical straps 72—shown about to be conventionally fastened—are required. The assembled bin is ready for loading, transport and storage.

The reader will understand that the disclosed construction has substituted the tensile strength of the plywood for that of the prior art bands. Typically, routed groove 46 passes through 3 plys of a nine ply thickness with return 42 fitting into the defined groove. It will further be understood that the disclosed construction is capable of retro fit as well as being utilized with newly constructed bins.

These and other advantages will become more apparent after reference is made to the following claims.

What is claimed is:

1. In a paste bin having in combination;

an upwardly exposed rectilinear bin bottom having first and second parallel and opposite sides and a pallet;

paired first sides for fitting to said pallet at said opposite first parallel sides of said bin bottom, each said side having an interior facing surface and an exterior facing surface;

paired second sides for fitting to said pallet at said opposite second parallel sides of said bin bottom, each said side having an interior facing surface and an exterior facing surface; and, a downward exposed rectilinear bin top having first and second parallel and opposite sides dimensioned for fitting to said paired first and second sides;

the improvement in said bins comprising in combination:

four self locking corner irons, each said iron comprising in combination;

an elongate strip bent to an approximate 90° angle for forming a first side contacting portions and a second side contacting portion;

one of said side contacting portions including means for permanently fastening to a first of said bin sides;

the other of said side contacting portions including means for releasable keying to a second of said bin sides at an exterior facing surface, said other of said side contacting portions not including means for permanently fastening to said second of said bin sides at said exterior facing surface;

key receiving means defined on the outside edge of said second of said bin sides whereby when said self locking corner irons are affixed to said one of said sides and the other of said sides is biased into said self locking corner irons, said container is maintained in an erected self locking disposition without permanent attachment between said second bin side and said side contact portion.

2. The paste bin of claim 1 and wherein said means for permanently fastening to one of said bin sides includes:

annular protrusions with a central bore from said corner locking iron to and toward said sides; and, said side includes counter sunk apertures with central bores, said counter sunk apertures for mating with said annular protrusions to key said corner irons to said sides.

3. The paste bin of claim 2 and wherein said means for permanently fastening further includes a T-nut extending from said central bore and a flat head machine screw for extending from said bore in said corner iron to said T-nut for fastening said corner iron to said side.

4. The paste bin of claim 1 and wherein said key receiving means defined on the outside edge of said other of said bin sides includes a saw kerf.

5. The paste bin of claim 4 and wherein said means for keying includes a return bent at 90°.

6. In a process for the erection of a paste bin wherein said paste bin includes:

an upwardly exposed rectilinear bin bottom having first and second parallel and opposite sides;

paired first sides for fitting to said pallet at said opposite first parallel sides of said bin bottom, each said side having an interior facing surface and an exterior facing surface;

paired second sides for fitting to said pallet at said opposite second parallel sides of said bin bottom, each said side having an interior facing surface and an exterior facing surface; and, a downward exposed rectilinear bin top having first and second parallel and opposite sides dimensioned for fitting to said paired first and second sides;

the process of erecting said paste bin comprising the steps of:

providing four self locking corner irons, each said provided iron comprising in combination;

an elongate strip bent to an approximate 90° angle for forming a first side contacting portions and a second side contacting portion;

one of said side contacting portions including means for permanently fastening to one of said bin sides;

the other of said side contacting portions including means for releasable keying to the other of said bin sides at an exterior facing surface, said other of said side contacting portions not including means for permanently fastening to said second of said bin sides at said exterior facing surface;

fastening said elongate strip to two of said sides at opposite side edges of said sides with said means for keying to one of said bin sides protruding from said opposite sides edges of said bin sides;

providing key receiving means defined on the outside edge of said other of said bin sides whereby when said self locking corner irons are affixed to said one of said sides and the other of said sides is biased into said self locking corner irons, said container is maintained in an erected self locking disposition without permanent attachment between said second bin side and said side contact portion;

erecting at least one of said sides with permanently fastened corner irons on opposite sides of said bottom on said pallet;

placing at least one said other side to said erected sides and moving said side at said key receiving means to register with means for keying to the other of said bin sides to enable said sides to come into self locking engagement.

7. The process for the erection of a paste bin of claim 6 and further including:

providing means for temporarily locking said sides in said locked disposition; and, installing said means for temporarily locking said sides when said sides are engaged one with respect to another.

8. In a paste bin having in combination;

a pallet bottom having fork receiving on pallet sides formed with an integral upwardly exposed bin bottom;

paired off pallet sides for fitting to said pallet at said off pallet sides of said bin bottom, each said side having an interior facing surface and an exterior facing surface;

paired on pallet sides for fitting to said pallet at said on pallet sides of said bin bottom, each said side having an interior facing surface and an exterior facing surface; and, a top having side spacing downward exposed cleats for receiving and spacing said respective paired on pallet and off pallet sides;

the improvement in said bins comprising in combination:

four self locking corner irons, each said iron comprising in combination;

an elongate strip bent to an approximate 90° angle for forming a first off pallet side contacting portions and a second on pallet side contacting portion;

one of said side contacting portions including means for permanently fastening to one of said bin sides;

the other of said side contacting portions including means for releasable keying to the other of said bin sides at an exterior facing surface, said other of said side contacting portions not including means for permanently fastening to said second of said bin sides at said exterior facing surface;

key receiving means defined on the outside edge of said other of said bin sides whereby when said self locking corner irons are affixed to said one of said sides and the other of said sides is biased into said self locking corner irons, said container is maintained in an erected self locking disposition without permanent attachment between said second bin side and said side contact portion.

9. The paste bin of claim 8 and wherein said means for permanently fastening to one of said bin sides includes:

annular protrusions with a central bore from said corner locking iron to and toward said sides; and, said side includes counter sunk apertures with central bores, said counter sunk apertures for mating with said annular protrusions to key said corner irons to said sides.

10. The paste bin of claim 9 and wherein said means for permanently fastening further includes a T-nut extending from said central bore and a flat head machine screw for extending from said bore in said corner iron to said T-nut for fastening said corner iron to said side.

11. The paste bin of claim 8 and wherein said key receiving means defined on the outside edge of said other of said bin sides includes a saw kerf.

12. The paste bin of claim 11 and wherein said means for keying includes a return bent at 90°.

13. In a process for the erection of a paste bin wherein said paste bin includes:

a pallet bottom having fork receiving on pallet sides formed with an integral upwardly exposed bin bottom;

paired off pallet sides for fitting to said pallet at said off pallet sides of said bin bottom, each said side having an interior facing surface and an exterior facing surface;

paired on pallet sides for fitting to said pallet at said on pallet sides of said bin bottom, each said side having an interior facing surface and an exterior facing surface; and, a top having side spacing downward exposed cleats for receiving and spacing said respective paired on pallet and off pallet sides;

the process of erecting said paste bin comprising the steps of:

providing four self locking corner irons, each said provided iron comprising in combination;

an elongate strip bent to an approximate 90° angle for forming a first off pallet side contacting portions and a second on pallet side contacting portion;

one of said side contacting portions including means for permanently fastening to one of said bin sides;

the other of said side contacting portions including means for releasable keying to the other of said bin sides at an exterior facing surface, said other of said side contacting portions not including means for permanently fastening to said second of said bin sides at said exterior facing surface;

fastening said elongate strip to two of said sides at opposite side edges of said sides with said means for keying to one of said bin sides protruding from said opposite sides edges of said bin sides;

providing key receiving means defined on the outside edge of said other of said bin sides whereby when said self locking corner irons are affixed to said one of said sides and the other of said sides is biased into said self locking corner irons, said container is maintained in an erected self locking disposition;

erecting said sides with permanently fastened corner irons on opposite sides of said bottom on said pallet;

placing at least one said other side between said erected sides and moving said side at said key receiving means to register with means for keying to the other of said bin sides to enable said sides to come into self locking engagement without permanent attachment between said second bin side and said side contact portion.

14. The process for the erection of a paste bin of claim 6 and further including:

providing means for temporarily locking said sides in said locked disposition; and, installing said locking means when said sides are engaged one with respect to another.

* * * * *